US007753211B2

(12) United States Patent
Rem et al.

(10) Patent No.: US 7,753,211 B2
(45) Date of Patent: Jul. 13, 2010

(54) METHOD AND DEVICE FOR SEPARATING SOLID PARTICLES ON THE BASIS OF A DIFFERENCE IN DENSITY

(75) Inventors: Peter C. Rem, Rijswijk (NL); Simon P. Berkhout, Schipluiden (NL); Erwin J. Bakker, Gravenhage (NL)

(73) Assignee: Bakker Holding Son B.V. (NL)

( * ) Notice: Subject to any disclaimer, the term of this patent is extended or adjusted under 35 U.S.C. 154(b) by 474 days.

(21) Appl. No.: 11/643,124

(22) Filed: Dec. 21, 2006

(65) Prior Publication Data

US 2007/0163926 A1 Jul. 19, 2007

(30) Foreign Application Priority Data

Dec. 23, 2005 (NL) ..... 1030761

(51) Int. Cl.
*B03C 1/30* (2006.01)
*B03B 5/66* (2006.01)

(52) U.S. Cl. ..... 209/39; 209/40; 209/131; 209/155; 209/156; 209/157

(58) Field of Classification Search ..... 209/155, 209/156, 157, 131, 232, 39, 40
See application file for complete search history.

(56) References Cited

U.S. PATENT DOCUMENTS 3,294,237 A * 12/1966 Weston ..... 209/214
3,483,968 A 12/1969 Kaiser
3,507,389 A * 4/1970 Goulstone et al. ..... 209/636
3,788,465 A 1/1974 Reimers et al.
4,062,765 A * 12/1977 Fay et al. ..... 209/1
4,085,037 A 4/1978 Quets et al.
4,961,841 A * 10/1990 Andres et al. ..... 209/1
5,541,072 A 7/1996 Wang et al.
5,865,970 A * 2/1999 Stelter ..... 204/298.19
5,957,298 A * 9/1999 Buske et al. ..... 209/39
6,136,182 A 10/2000 Dolan et al.
2003/0150816 A1* 8/2003 Sacs ..... 210/695
2007/0163926 A1* 7/2007 Rem et al. ..... 209/155

FOREIGN PATENT DOCUMENTS

| | | |
|---|---|---|
| DE | 44 47 362 | 7/1996 |
| EP | 0 362 380 | 4/1990 |
| EP | 0 839 577 | 5/1998 |
| WO | WO 9716835 A1 * | 5/1997 |

* cited by examiner

*Primary Examiner*—Patrick Mackey
*Assistant Examiner*—Terrell H Matthews
(74) *Attorney, Agent, or Firm*—Connolly Bove Lodge & Hutz LLP

(57) ABSTRACT

The invention relates to a method of separating solid particles, using a magnetic fluid, wherein the magnetic fluid is passed through a magnetic field for the purpose of changing the effective density of the magnetic fluid, and the particles are separated into fractions of different density. The present invention further relates to device for separating solid particles, using a magnetic fluid.

20 Claims, 3 Drawing Sheets

METHOD AND DEVICE FOR SEPARATING SOLID PARTICLES ON THE BASIS OF A DIFFERENCE IN DENSITY

CROSS-REFERENCE TO RELATED APPLICATION

This application claims benefit to Dutch patent application number 1030761 filed Dec. 23, 2005.

DESCRIPTION

The present invention relates to a method of separating solid particles, using a magnetic fluid, wherein the magnetic fluid is passed through a magnetic field for the purpose of changing the effective density of the magnetic fluid, and the particles are separated into fractions of different density. The present invention further relates to a device for separating solid particles, using a magnetic fluid, wherein the magnetic fluid is passed through a magnetic field for the purpose of changing the effective density of the magnetic fluid, said device comprising means for supplying the magnetic fluid, means for supplying the particles to be separated, means for discharging fractions of different density, means for generating the magnetic field, as well as the necessary supply and discharge pipes.

From U.S. Pat. No. 4,062,765 a process is known wherein separation of a mixture of non-magnetic particles on the basis of their different densities is accomplished by means of a magnetic fluid, using a multiplicity of magnetic gaps created by a grid of magnetic poles oriented with respect to each other such that the polarity of the magnetic field generated in each gap is opposite to that of each adjacent gap. Because of the required presence of gaps, particles having a density higher than the apparent density of the magnetic fluid at the critical points will pass through the plane of the critical points and be discharged in downward direction through the openings in the gaps into a bin disposed thereunder. A non-uniform magnetic field gradient is generated in the magnetic fluid, said gradient producing in said magnetic fluid a vertical force component in the direction opposite to gravity, said vertical force component decreasing in magnitude in the direction opposite to gravity and having critical points below which the contours of constant force thereof are discontinuous and above which said contours of constant force are continuous. A drawback of such a configuration is that the volume having the strongest magnetic field is populated by the fraction that sinks, with FIG. 5 of said U.S. patent clearly showing that particles of the fraction that floats must not come closer than the contour of 300, otherwise they run the risk of sinking, whilst the magnet generates forces having a magnitude of 700. Another drawback of such a configuration is the fact that magnetic materials will adhere to the poles and that even the non-magnetic particles from the fraction that sinks may deposit on and around the magnet poles, which would lead to clogging. To prevent said coagulation of particles, it is according to FIG. 5 desirable not to go any further than the contour of 100-200, which renders the method according to said U.S. patent very unattractive in terms of magnetic efficiency.

From European patent application No. 0 839 577 a ferrohydrostatic separation method is known, in which the apparent density of a so-called ferrofluid is controlled by a solenoid. Such a separation apparatus is claimed to enable separation of a material into one or more fractions consisting of floating, suspended and sinking fractions.

From European patent application No. 0 362 380 a ferrohydrostatic separator is known, in which the separation takes place on the basis of differences in density. The method disclosed therein has four major drawbacks: (a) magnetic particles in the feed material will be attracted to the poles and cause clogging, (b) the feed material is separated in only two product flows, (c) the width of the gap is not readily upscalable: in the case of larger gap widths, the particles to be separated tend to drop to the center, so that the separation space is used inefficiently, (d) electric energy is required for maintaining the magnetic field.

From U.S. Pat. No. 3,788,465 an apparatus for a so-called magneto-gravimetric separation is known, in which the magnetic field exerts such forces on a particle immersed in the magnetic fluid that a separation into several fractions is claimed to be possible. The apparatus is tilted, so that the field strength decreases mainly in horizontal direction. Depending on the density, the particles fall through the fluid at different angles with respect to the vertical, so that it is in principle possible to separate a large number of product flows, each having its own density. It is mentioned in said document that magnetic particles can be treated as well. This seems improbable, however. A drawback of such a construction is the upscalability thereof and the fact that the particles are discharged in different directions, which implies that the particles need to be fed very closely along a line or that the separation space must be very large in order to obtain a good separation efficiency.

From U.S. Pat. No. 3,483,968 a method of separating materials of different density is known, in which use is made of a magnetic field having a specific vertical gradient, as a result of which objects of different density will take up a specific position in the fluid. Solid objects will float at different levels so as to enable easy separation thereof. According to said U.S. patent, a magnetic field is used whose strength decreases in upward direction at a rate slower than in a linear relationship, as a consequence of which particles of different density will be suspended at a vertical level specific for the respective density thereof, at which level said particles can be collected separately from each other. Because of the use of a magnetic field having one (in this case vertical) orientation, the particles will tend to drop to the sides of the container over the equipotential planes, leading to homogeneity problems.

U.S. Pat. No. 5,541,072 relates to a method for separation of magnetic particles, wherein magnetic particles are used within a multi-phase system. The magnetic particles bind with a so-called "target substance" in the carrier fluid, after which a separation takes place under the influence of a magnetic field. A number of biological substances are mentioned as the substances to be separated.

U.S. Pat. No. 6,136,182 discloses more or less the same principle as the aforesaid U.S. Pat. No. 5,541,072, in particular as regards the magnetic labelling of the so-called "target entities".

The object of the present invention is to provide a method and a device for separating solid particles on the basis of a difference in density, wherein the problems of the prior art as discussed in the foregoing are avoided.

Another object of the present invention is to provide a method and a device for separating solid particles on the basis of a difference in density, wherein solid particles can be separated over a wide density range by suitably selecting the strength of the magnetic fluid.

Yet another object of the present invention is to provide a method and a device for separating solid particles on the basis of a difference in density, wherein homogeneity problems are prevented and wherein furthermore movement of particles along the wall is to be minimised.

The method as referred to in the introductory paragraph is characterised in that the magnetic field is generated by a permanent magnet made up of strips of at least two alternating orientations, in particular an alternating orientation of east, north, west and south.

One or more of the above objects are achieved by using such a method. More in particular, the present invention employs a magnetic field under a substantially flat surface, using permanent magnets, so that no electric energy is required for maintaining the magnetic field. In addition, the present invention employs permanent magnets made up of strips having poles in alternating orientation. Thus the present inventors have found that a magnetic field is obtained which is constant in one of the two horizontal directions and which appears to rotate more or less in the other direction. It has thus been found that the strength of the magnetic field decreases exponentially in vertical direction with a half-value length that is related to the wavelength in horizontal direction.

In a construction thus configured, the field strength has been found to be independent of the two horizontal coordinates at a height some distance above the surface of the magnet. The advantage of this is that the magnetic field is fully upscalable in both horizontal directions. However, the present inventors have moreover found that major fluctuations occur near the magnet, which implies that the space with the strongest magnetic field cannot be utilised on account of said fluctuations. By using strips of four types of poles, viz. north, south, east and west in the present construction, a magnetic field having a constant field strength in horizontal direction is already realised at a small distance above the surface of the magnet.

The permanent magnet is so constructed that a liquid-tight surface is formed, so that in fact a separation of solid particles takes place on one side. In a special embodiment, the strips abut against each other, possibly separated by strips of a non-magnetic material, for example strips of stainless steel. Such a surface prevents magnetic fluid as well as solid particles to be separated from passing through the magnet.

In a special embodiment it is preferable if the magnet is made up of strips of separate magnets, each having an orientation selected from the orientations east, north, west and south, wherein it is in particular preferable if the orientation of the magnet is supplemented by the orientations north-east, between east and north, north-west, between north and west, west-south, between west and south, and south-east, between south and east. The use of such a magnet has an advantageous effect as regards obtaining a magnetic field whose field strength is independent of the two horizontal coordinates and which are thus readily upscalable.

Advantageous results are obtained in particular if the magnet is made up of separate strips of magnets, each having an orientation selected from the orientations east, north-east, north, north-west, west, west-south, south and south-east.

Although the field strength is independent of the two horizontal coordinates at a height some distance above the surface of the magnet, the present inventors have found that major fluctuations occur near the surface of the magnet. This aspect has consequences as regards the economy of the method, because the effect $$\rho=\rho(\text{magnetic fluid})+\mu_o M(\text{magnetic fluid})dH/dz$$

must be effected by the use of a concentrated fluid (high magnetisation M) (more expensive than a water-diluted fluid) in case of a small dH/dz value. By thus using strips of four types of poles, a constant field strength is already realised at a small height above the surface. By subsequently designing the poles to have a non-flat shape at the upper side thereof, an even larger part of the magnetic field can be utilised. In a special embodiment it is therefore desirable to provide the strips of the magnet with rounded corners at the side that faces towards the fluid.

In order to obtain an optimum utilisation of the strength of the magnetic field, it is preferable if the minimum distance between the upper side of the magnet and the magnetic fluid is selected so that the magnetic field in the magnetic fluid is substantially constant in both horizontal directions, with the strength of the magnetic field in the magnetic fluid decreasing exponentially in vertical direction.

According to the present invention, therefore, homogeneity of the magnetic field in the horizontal plane must be enforced, in particular by a) using a magnet comprising strips in a number of magnetization directions, which appear to rotate in the direction perpendicular to the strip orientation, b) rounding the corners of the pole strips, and c) making use of the magnetic field beyond a minimum distance from the magnet.

It should be noted that each of these three aspects in itself suffices for obtaining the desired result: i) the magnetization can be made to rotate continuously, so that it is now possible to use the field directly above the surface, which field will have a maximum strength, ii) two pole directions (N, S) can now be used, in which case the corners are extremely rounded, so that it is now possible to use the field directly above the surface, which field will be less strong than in option ii), however, and iii) two pole directions (N, S) can now be used, only using the field quite a distance above the surface of the magnet, which field will be weak in that case. In practice the costs and the technological possibilities of building the construction and the costs of the consumption of magnetic fluid will have to be weighed against each other, in which connection it should be noted that the latter costs will be minimal in case of a high field.

In practice the material to be separated will contain a plurality of constituents of varying origin and dimensions. To obtain a uniform and homogeneous mixture of the particles to be separated, it is therefore preferable if the particles to be separated are first supplied to the magnetic fluid, after which the magnetic fluid thus laden with particles is passed through the magnetic field, in which case it is preferable, in order to obtain an advantageous separation, if the magnetic fluid flows through the magnetic field under laminar conditions.

The method according to the present invention can be carried out in such a manner that the magnetic fluid is present either above or below the magnet.

By screening the magnet from the magnetic fluid, the surface of the magnet is prevented from being covered with magnetic particles, which would affect the magnetic field adversely. In a special embodiment, an endless conveyor belt is preferably provided between the magnetic fluid and the magnet, the direction of movement of which conveyor belt is different from the conveying direction of the magnetic fluid, wherein in particular the direction of movement of the conveyor belt is perpendicular to the conveying direction of the magnetic fluid. Using the present method, it is possible to separate more than two fractions of particles. Especially in the situation in which the magnets are disposed under the magnetic fluid, all fractions will be reclaimed above the surface of the magnets.

To prevent accumulation of particles, the conveyor belt is preferably provided with means for discharging solid particles that are present on the conveyor belt in the direction of movement of the conveyor belt.

The present inventors have carried out experiments in which the orientation of the magnetic field was constant in the conveying direction of the magnetic fluid, which means that the fluid flow took place parallel to the orientation east, north, west and south.

The present invention further relates to a device for separating solid particles, which device is according to the present invention characterised in that the means for generating the magnetic field comprise a permanent magnet made up of strips of at least two alternating orientations, in particular an alternating orientation of east, north, west and south, said magnet in particular being made up of separate magnets, each having an orientation selected from the orientations east, north, west and south.

To obtain a field strength that is substantially independent in both horizontal coordinates, it is preferable if the orientation of the magnet is supplemented by orientation strips of north-east, between east and north, north-west, between north and west, west-south, between west and south, and south-east, between south and east, in particular if the magnet is made up of separate magnets, each having an orientation selected from the orientations east, north-east, north, north-west, west, west-south, south and south-east.

To obtain an improved utilisation of the magnetic field having a high field strength, namely near the surface of the magnet, the strips of the magnet are provided with rounded corners at the side that faces towards the fluid.

The present device preferably has a horizontal configuration, so that the particles to be separated will flow along with the fluid, rather than a slightly inclined configuration, in which the particles to be separated move with respect to the fluid under the influence of a component of the force of gravity or the magnetic field. An inclined construction is undesirable in some embodiments, because in such a situation the conveying velocity of the particles and thus the yield is related to the particle size, in which connection it should be noted in particular that especially small particles, viz. particles having a dimension ranging between 0.5 and 10 mm, do not move rapidly of their own account. By having the particles to be separated flow along with the magnetic fluid on an endless conveyor belt in the present invention, the movement of the particles to be separated relative to the magnetic fluid is only limited to the separation in vertical direction, and the magnetic fluid can provide the transport in horizontal direction over the magnet, with the magnetic fluid at no point being in contact with the magnet. By providing such a conveyor belt with upright edges, for example, the particles present on the conveyor belt will be removed in the direction of movement of the conveyor belt. Examples of particles to be separated are plastics and metals, for example recycled materials such as PET, polypropylene (PP), polyethylene (PE), PVC, but also diamonds from ores and gold from recycling materials, such as discarded computers and printed circuit boards.

In some embodiments it is preferable to place the magnet above the fluid, so that the magnetic fluid will be lighter than water, which is desirable in particular in case of a polypropylene-polyethylene separation. A suspension of, for example, iron oxide particles may be used as the magnetic fluid.

In a special embodiment of the present invention, the inventions assume that the permanent magnet can be substituted for superconductive current supply wires.

The present invention will now be explained by means of an example, in which connection it should be noted, however, that the present invention is by no means limited to such a special example.

DESCRIPTION OF THE FIGURES

The magnet configuration that is shown in FIG. 1 consists of a permanent magnet and a pole of alternating orientation, so that a magnetic field is obtained which is constant in one of the two horizontal directions and which appears to rotate in the other direction. It has thus become apparent that the strength of the magnetic field decreases exponentially in vertical direction with a half-value length that is related to the wavelength in horizontal direction, as is shown in FIG. 2. The field strength measured at a height some distance above the surface of the magnet appears to be independent of the two horizontal coordinates: the field is now fully upscalable near the horizontal directions. In FIG. 2 the strips of alternating orientation are clearly shown.

FIG. 3 shows a magnet according to a special embodiment of the present invention, in which the magnet has a slightly rounded corner at the upper side. The shape of the magnet that is shown in FIG. 3 makes it possible to realise an optimum use of the magnetic field, which means that the field can be used at a minimum distance from the surface of the magnet.

FIG. 4 shows a special embodiment of the magnet according to the present invention, in which strips of varying orientation are used, in particular north, west, south and east.

FIGS. 5 and 6 show effective densities of the magnetic fluid, in particular a ferrofluid, for two mutually different magnet configurations, FIG. 5 comprising the configuration as shown in FIG. 4 and FIG. 6 comprising a similar configuration, albeit with rounded corners, as schematically shown in FIG. 3.

Figure 1:
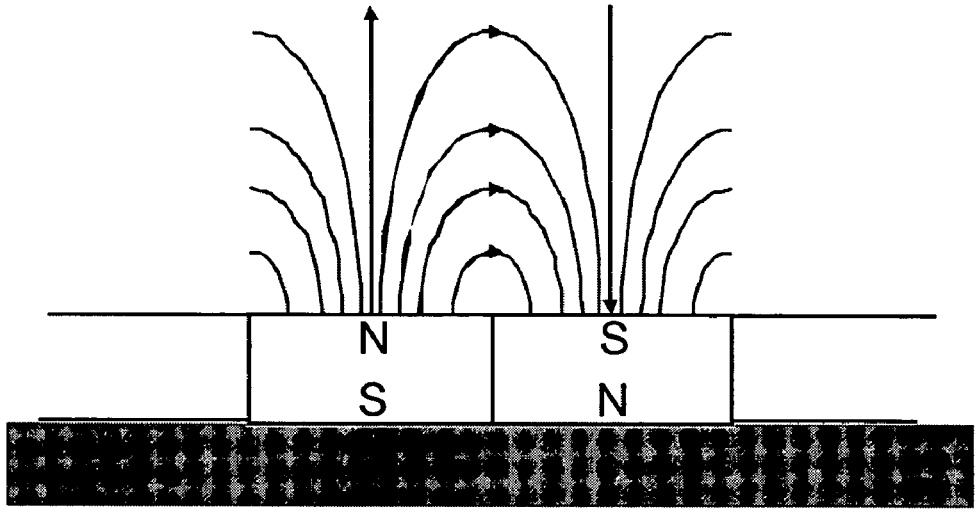
FIG. 1 schematically shows a method according to the present invention.
Figure 2:
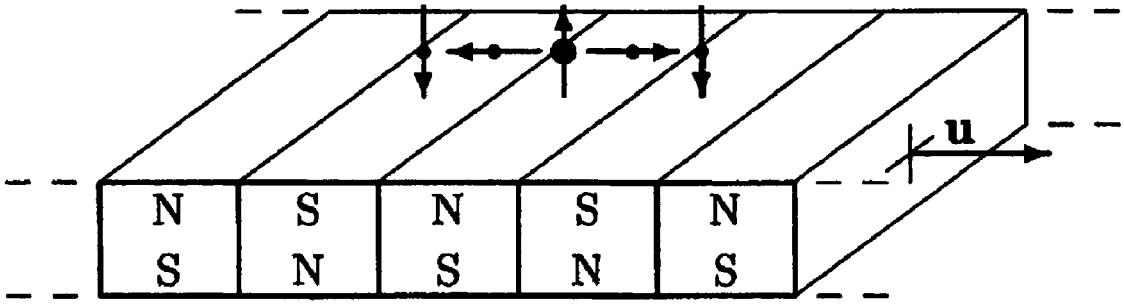
FIG. 2 is a perspective view of the magnet of FIG. 1.
Figure 3:
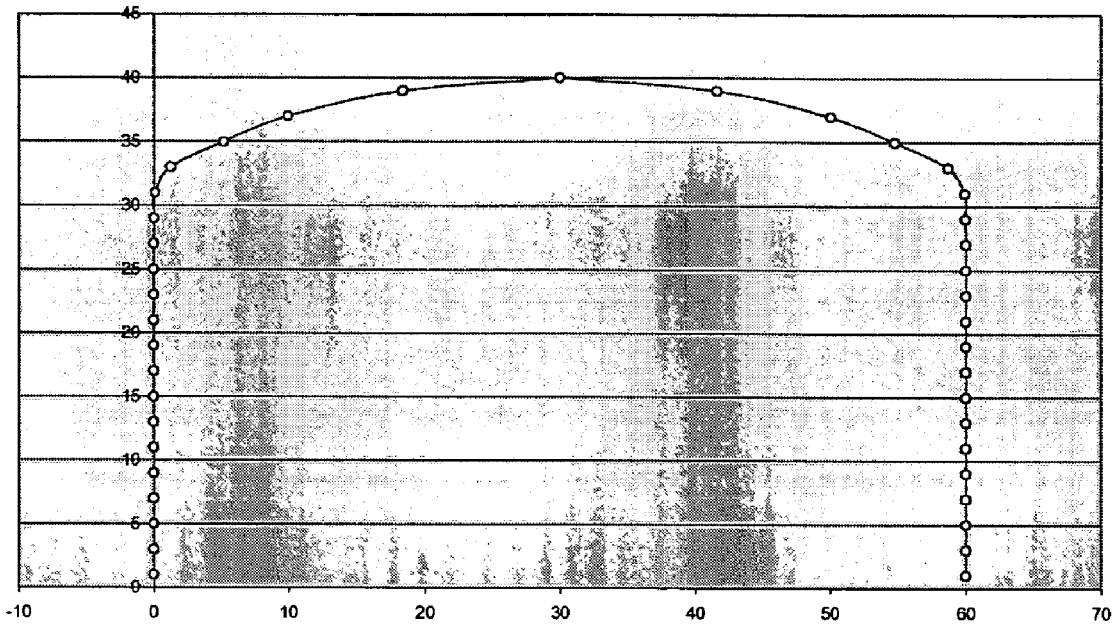
FIG. 3 shows a magnet according to a special embodiment of the present invention.
Figure 4:
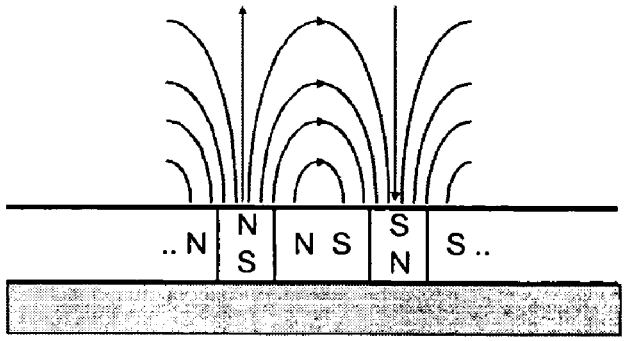
FIG. 4 shows a special embodiment of the magnet according to the present invention.
Figure 5:
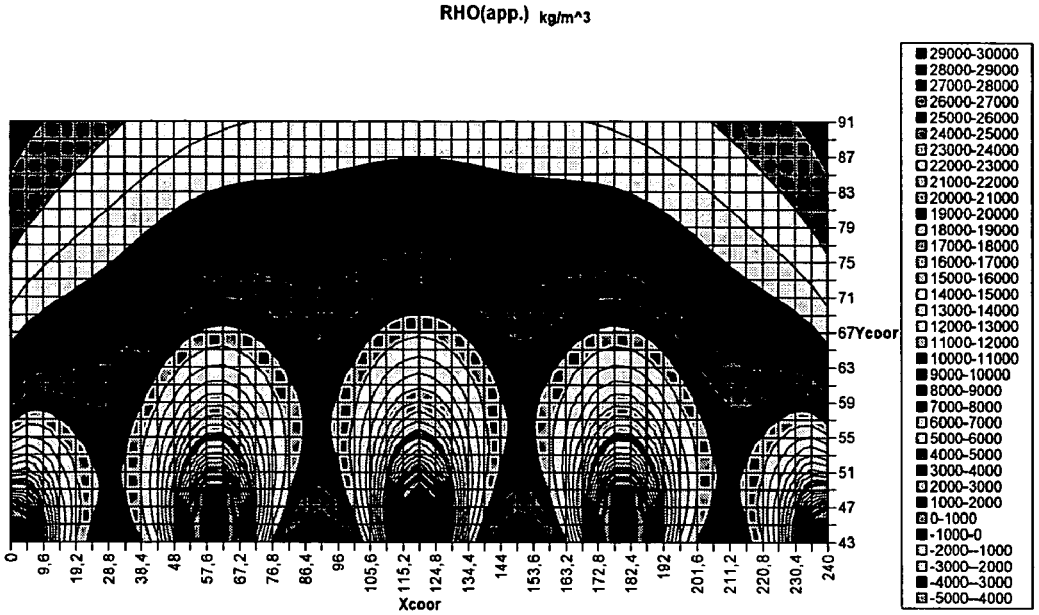
FIG. 5 shows the density profile above a magnet according to the present invention.
Figure 6:
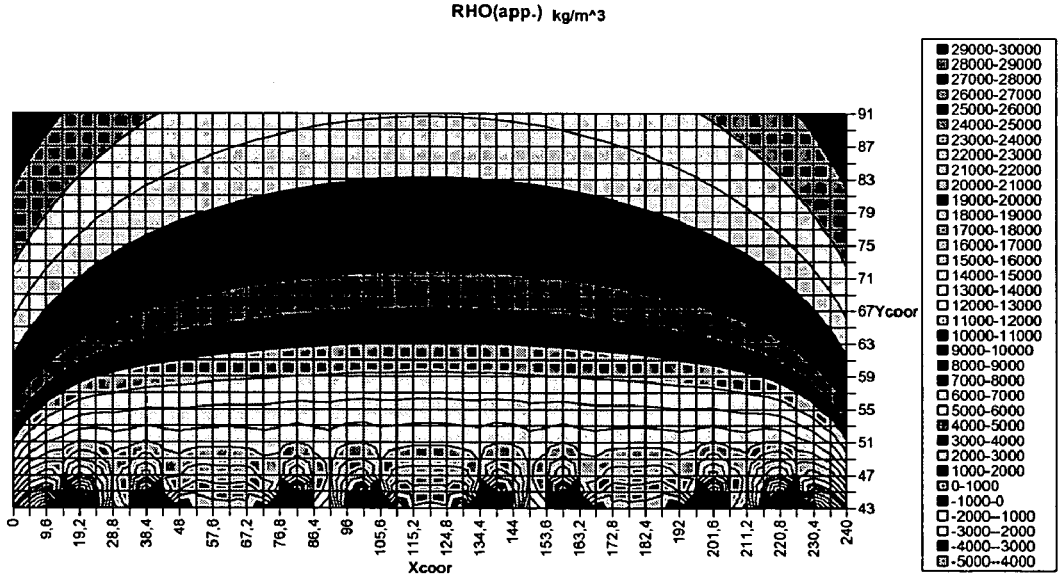
FIG. 6 shows a density profile above a magnet according to the present invention.

The non-adapted configuration (FIG. 5), viz. the configuration in which the magnets have a slightly flat shape, can only be used for a density separation at a height of 29 mm, with the height of the magnets being 40 mm, viz. 69−40=29 mm, in this configuration. In this case the density amounts to 11.000 kg/m$^3$, therefore. In the adapted configuration, as shown in FIG. 6, it is possible to carry out a separation at a height of 13 mm already, with an associated density of 14.000 kg/m$^3$. Thus the rounded corners, as used in the configuration of FIG. 3, have a positive influence as regards the effective use of the magnetic field.

The invention claimed is:

1. A method of separating solid particles, using a magnetic fluid, wherein the magnetic fluid is passed through a magnetic field for the purpose of changing the effective density of the magnetic fluid, and the particles are separated into fractions of different density, the magnetic field is generated by a permanent magnet made up of strips of at least two alternating orientations, the strips of the magnet having rounded corners at a side that faces towards the fluid, and the minimum distance between an upper side of the magnet and the magnetic fluid being selected so that the magnetic field in the magnetic fluid is substantially constant in both horizontal directions, with the strength of the magnetic field in the magnetic fluid decreasing exponentially in a vertical direction.

2. A method according to claim 1, wherein the magnet is made up of strips of an alternating orientation of east, north, west and south.

3. A method according to claim 1, wherein the magnet is made up of separate magnets, each comprising a strip having an orientation selected from the orientations east, north, west and south.

4. A method according to claim 3, wherein the orientation of the magnet is supplemented by the orientations north-east, between east and north, north-west, between north and west, west-south, between west and south, and south-east, between south and east.

5. A method according to claim 3, wherein the magnet is made up of separate magnets, each having an orientation selected from the orientations east, north-east, north, north-west, west, west-south, south and south-east.

6. A method according to claim 1, wherein the particles to be separated are first supplied to the magnetic fluid, after which the magnetic fluid thus laden with particles is passed through the magnetic field.

7. A method according to claim 1, wherein the magnetic fluid flows through the magnetic field under laminar conditions.

8. A method according to claim 1, wherein the magnetic fluid is present above the magnet and is screened from the magnet.

9. A method according to claim 7, wherein the magnetic fluid is present under the magnet.

10. A method according to claim 8, wherein an endless conveyor belt is provided between the magnetic fluid and the magnet, the direction of movement of which conveyor belt is different from the conveying direction of the magnetic fluid.

11. A method according to claim 10, wherein the direction of movement of the conveyor belt is perpendicular to the conveying direction of the magnetic fluid.

12. A method according to claim 11, wherein the conveyor belt is provided with means for discharging solid particles that are present on the conveyor belt in the direction of movement of the conveyor belt.

13. A method according to claim 1, wherein the orientation of the magnetic field is constant in the conveying direction of the magnetic fluid.

14. A method according to claim 1, wherein the strips are so arranged that a dense surface is obtained.

15. A device for separating solid particles, using a magnetic fluid, wherein the magnetic fluid is passed through a magnetic field for the purpose of changing the effective density of the magnetic fluid, the device comprising means for supplying the magnetic fluid, means for supplying the particles to be separated, means for discharging fractions of different density, means for generating the magnetic field, as well as the necessary supply and discharge pipes, and wherein the means for generating the magnetic field comprises a permanent magnet made up of strips of at least two alternating orientations; wherein the magnet has rounded corners at the side that faces towards the fluid.

16. A device according to claim 15, wherein the permanent magnet is made up of strips of an alternating orientation of east, north, west and south.

17. A device according to claim 16, wherein said magnet is made up of strips of separate magnets, each having an orientation selected from the orientations east, north, west and south.

18. A device according to claim 17, wherein the orientation of the magnet is supplemented by north-east, between east and north, north-west, between north and west, west-south, between west and south, and south-east, between south and east.

19. A device according to claim 18, wherein the magnet is made up of strips of separate magnets, each having an orientation selected from the orientations east, north-east, north, north-west, west, west-south, south and south-east.

20. A method according to claim 19, wherein the strips are so arranged that a dense surface is obtained.

* * * * *